US010837333B2

(12) United States Patent
Ayesh et al.

(10) Patent No.: US 10,837,333 B2
(45) Date of Patent: Nov. 17, 2020

(54) EXHAUST SYSTEM HAVING TUNABLE EXHAUST SOUND

(71) Applicant: Ford Global Technologies, LLC, Dearborn, MI (US)

(72) Inventors: Hani Ayesh, Canton, MI (US); Shawn Carney, Ypsilanti, MI (US); Marlowe Ma, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 391 days.

(21) Appl. No.: 15/856,462

(22) Filed: Dec. 28, 2017

(65) Prior Publication Data

US 2019/0203619 A1 Jul. 4, 2019

(51) Int. Cl.

| | |
|---|---|
| ***F01N 1/00*** | (2006.01) |
| ***F01N 1/02*** | (2006.01) |
| ***F01N 1/18*** | (2006.01) |
| ***F01N 1/08*** | (2006.01) |
| ***F01N 1/16*** | (2006.01) |

(52) U.S. Cl.

CPC ..... *F01N 1/006* (2013.01); *F01N 1/02* (2013.01); *F01N 1/023* (2013.01); *F01N 1/08* (2013.01); *F01N 1/16* (2013.01); *F01N 1/18* (2013.01); *F01N 2210/04* (2013.01); *F01N 2470/04* (2013.01); *F01N 2490/12* (2013.01); *F01N 2490/15* (2013.01); *F01N 2530/00* (2013.01)

(58) Field of Classification Search

CPC ..... F01N 2210/04; F01N 1/006; F01N 1/02; F01N 1/023; F01N 1/08; F01N 1/16; F01N 1/18; F01N 2470/04; F01N 2490/12; F01N 2490/15; F01N 2530/00

See application file for complete search history.

(56) References Cited

U.S. PATENT DOCUMENTS

| | | | | |
|---|---|---|---|---|
| 7,222,004 | B2 | 5/2007 | Anderson | |
| 8,418,445 | B2 * | 4/2013 | Laube | F01N 1/00 181/238 |
| 9,109,483 | B2 * | 8/2015 | Winkel | F01N 13/107 |
| 2004/0006970 | A1 * | 1/2004 | Worner | F01N 1/166 60/272 |
| 2008/0302597 | A1 * | 12/2008 | Kruger | F01N 13/02 181/238 |
| 2012/0111663 | A1 * | 5/2012 | Havener | F01N 1/006 181/272 |

(Continued)

*Primary Examiner* — Forrest M Phillips
(74) *Attorney, Agent, or Firm* — Dykema Gossett PLLC

(57) ABSTRACT

The disclosed inventive concept provides a further achievement in efforts to produce a tunable exhaust sound for a vehicle. The system provides a tunable exhaust system including a tunable resonator and a pair of tunable mufflers. The tunable resonator includes a housing including first, second and third expansion chambers. A pair of bank-by-bank exhaust conduits extends through the housing. At least one of the conduits includes a band of peripheral perforations within the first expansion chamber. The band is formed at an angle relative to the long axis of the conduit on which it is formed. The mufflers include inlet and outlet pipes. At least one of the outlet pipes includes a variable exhaust gas flow assembly. The variable exhaust gas flow assembly includes a vane shaft, an exhaust gas regulating vane attached to the vane shaft, and a vane actuator for regulating the position of the vane shaft.

20 Claims, 14 Drawing Sheets

(56) References Cited

U.S. PATENT DOCUMENTS

| | | | | |
|---|---|---|---|---|
| 2014/0161671 | A1 | 6/2014 | Cuellar et al. | |
| 2017/0198617 | A1* | 7/2017 | Drees | F01N 13/02 |
| 2017/0276041 | A1* | 9/2017 | Hwang | F01N 13/04 |
| 2018/0202344 | A1* | 7/2018 | Klemenc | F01N 13/009 |

* cited by examiner

EXHAUST SYSTEM HAVING TUNABLE EXHAUST SOUND

TECHNICAL FIELD

The disclosed inventive concept relates generally to muffler systems for automotive vehicles. More particularly, the disclosed inventive concept relates to a muffler system incorporating acoustic attenuation devices for improving half order exhaust sound content from a V-8 engine. The acoustic attenuation devices include a three-chamber resonator and a dual mode muffler. The dual mode muffler may have an optional variable valve for selectively controlling exhaust volume.

BACKGROUND OF THE INVENTION

It is known in the automotive industry to utilize dual-flow exhaust systems having two exhaust conduits for directing exhaust gases away from the internal engine. The dual-flow exhaust system typically has two exhaust conduits directing exhaust gases away from an internal combustion engine. It may be particularly beneficial to use a dual-flow exhaust system in engines having a V-cylinder configuration. This is the case because of the layout and packaging of the engine components. The benefits include increased engine compactness and improved engine performance.

The dual-flow exhaust system is most commonly seen with vehicles having larger engines, such as engines having a V-cylinder configuration, typically a V8 engine. A performance vehicle having such an engine is expected by its owner to generate an aggressive exhaust sound coupled with a high level of power. In an effort to achieve improved engine sound, certain acoustic attenuation devices, such as resonators and mufflers, have been designed to reduce and in some case eliminate acoustic frequencies in dual-flow exhaust systems. In some cases, dual-resonators have been incorporated into the exhaust system. However, there may be several shortcomings with this type of design. The cost of the vehicle may be increased when multiple resonators are utilized as opposed to a single resonator. An additional undesirable result to this approach is the size increase of the exhaust system when multiple resonators are utilized. In response, attempts have been made to provide a desirable level of engine sound by using a single resonator to attenuate acoustic frequencies in both exhaust streams of dual-flow exhaust systems.

Regardless of the approach taken, the most desirable engine sound is typically characterized by high levels of specific ½ engine order acoustic content. The preferred method for delivering this sound is by having no mixing between the two banks of a dual exhaust system. However, this approach is compromised because, without mixing, the system loses desirable exhaust gas scavaging benefits normally achieved through the mixing of the left and right exhaust banks. The mixing of exhaust banks is known to help increase engine power as well as reducing undesired acoustic error states.

As in so many areas of vehicle technology there is always room for improvement related to the design of vehicle exhaust systems in an effort to provide the most desirable engine sound. A new approach that provides optimum and tunable engine sound is desired.

SUMMARY OF THE INVENTION

The disclosed inventive concept provides a further achievement in efforts to produce a tunable exhaust sound for a vehicle. The system provides a tunable exhaust system including a resonator and a pair of mufflers that work in harmony to produce a specific, preferred and adjustable exhaust sound. The resonator and muffler preferably work in conjunction with one another in a single system. However, it is conceivable that the resonator and mufflers can be used in separate vehicle systems.

In addition to the tunable resonator and mufflers, the tunable exhaust system includes pipes for delivering exhaust gases from the exhaust manifold system of the vehicle to the resonator and pipes for transferring the exhaust gases from the resonator to the mufflers. The tunable resonator includes a housing that defines an enclosure, a first expansion chamber defined by a front wall and a first baffle, a second expansion chamber defined by the first baffle and a second baffle, and a third expansion chamber defined by the second baffle and a back wall. In an additional embodiment of the resonator, an additional baffle may be provided between the first baffle and the front wall defining a dead chamber or space therein.

A pair of side-by-side exhaust conduits extends through the housing. At least one but preferably each of the conduits includes a band of peripheral perforations within the first expansion chamber. The band is formed at an angle relative to the long axis of the conduit on which it is formed.

At least one of the conduits has peripheral perforations formed on it in the second expansion chamber and the other of the conduits has peripheral perforations formed on it in the third expansion chamber. Additional but fewer peripheral perforations may be provided on the other conduit in each of the expansion chambers.

At least one tunable muffler is provided at the end of the tunable exhaust system of the disclosed inventive concept. Each muffler includes a housing defining an enclosure. The housing includes a front wall, a back wall, and a baffle therebetween. A first chamber is defined between the front wall and the baffle and a second chamber is defined by the baffle and the back wall. An inlet pipe extends through the front wall and the baffle and into the second chamber. The inlet pipe includes a series of peripheral perforations formed thereon, thereby defining the first chamber as an expansion chamber.

A pair of outlet pipes extends from the first chamber, through the baffle, and through the back wall. One or both of the outlet pipes may include peripheral perforations formed thereon within the second chamber. A Helmholtz tuner may extend from the first chamber, through the baffle, and into the second chamber.

A variable exhaust gas flow assembly is attached to one of the outlet pipes of each muffler. The variable exhaust gas flow assembly includes a vane shaft, an exhaust gas regulating vane attached to the vane shaft, and a vane actuator for regulating the position of the vane shaft. The exhaust gas regulating vane of the variable exhausts gas flow assembly may be infinitely variable.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1:
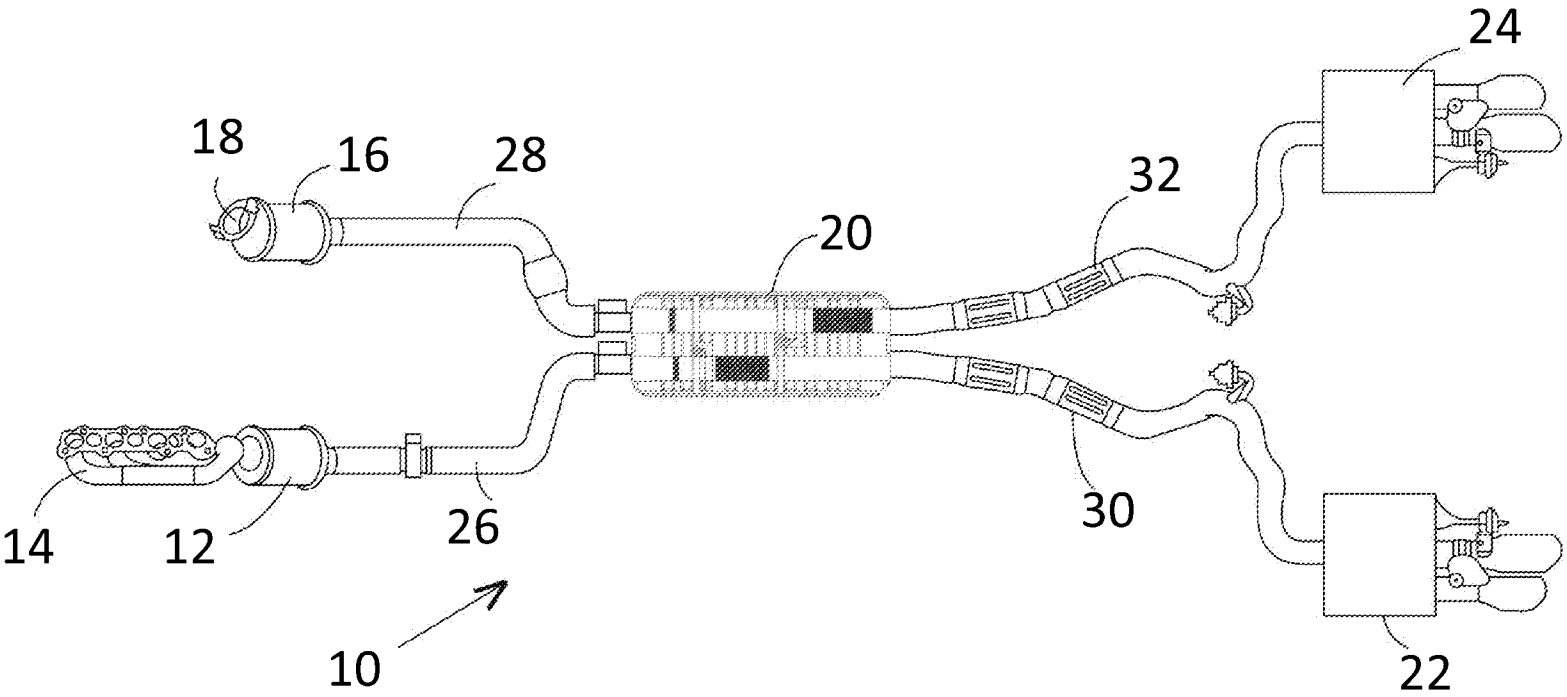
FIG. 1 is plan view of an exhaust system having a tunable exhaust sound according to the disclosed inventive concept.

In the following figures, the same reference numerals will be used to refer to the same components. In the following description, various operating parameters and components are described for different constructed embodiments. These specific parameters and components are included as examples and are not meant to be limiting.

The accompanying figures show various related interpretations of the disclosed inventive concept which provides an exhaust system having a tunable exhaust sound which incorporates a resonator, a pair of mufflers, and pipes to connect the resonator to the catalytic converters and the resonator to the mufflers. The exhaust system of the disclosed inventive concept is intended for use with engines having a V-configuration but may be adapted for use with other types of engines. In addition, while the exhaust system of the disclosed inventive concept illustrates described versions of resonators being used with described versions of mufflers with some mufflers having a variable exhaust gas flow assembly, the resonators and mufflers described herein can be used separately and not in combination in certain applications.

Figure 2:
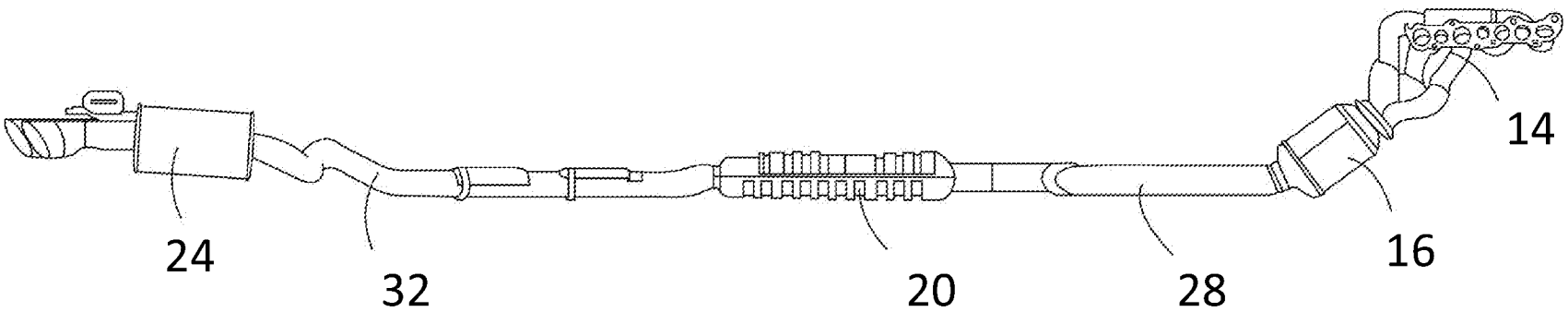
FIG. 2 is a side view of the exhaust system having a tunable exhaust sound of FIG. 1.
Figure 3:
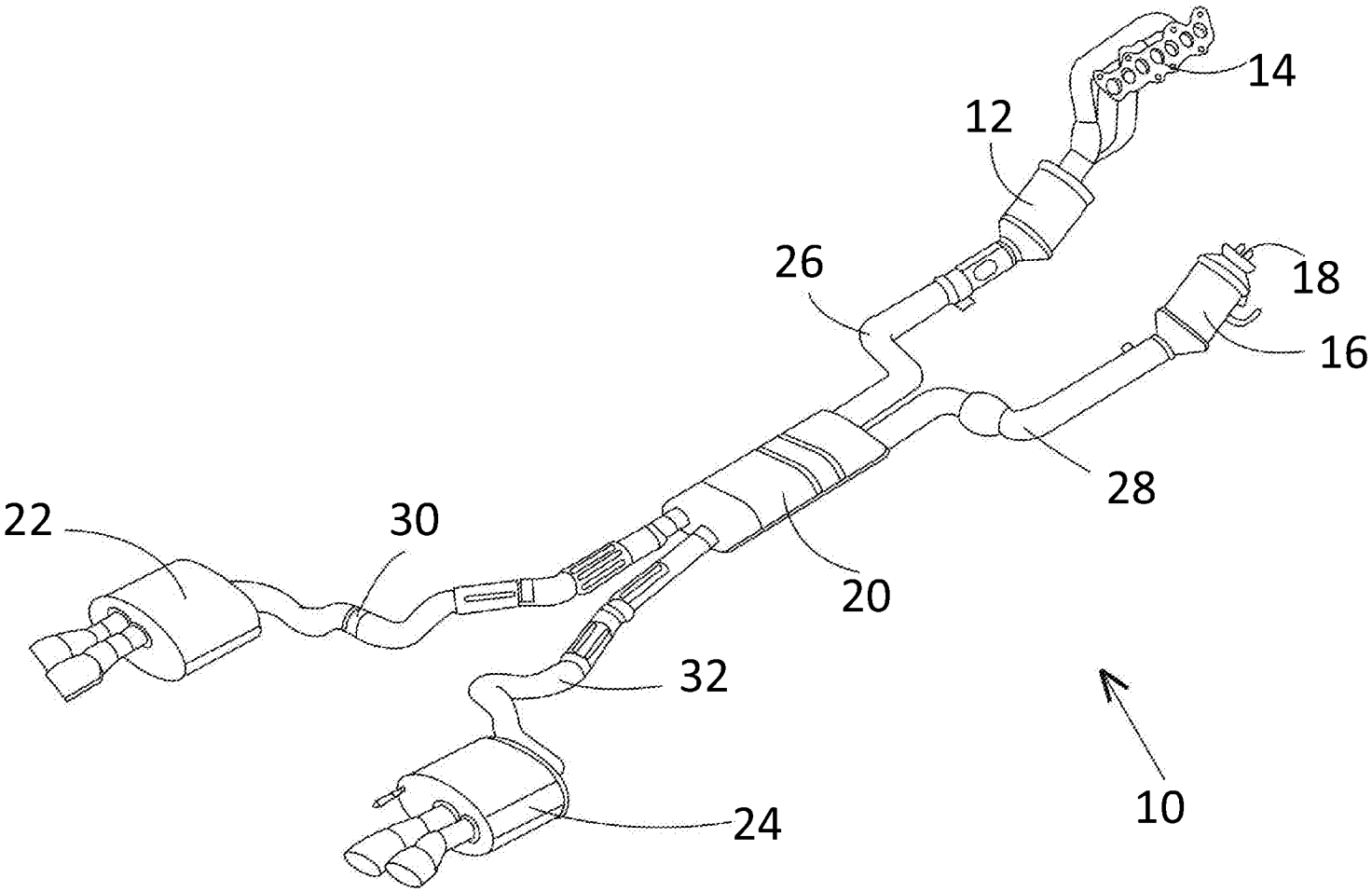
FIG. 3 is a perspective view of the exhaust system having a tunable exhaust sound of FIG. 1.

In general, the exhaust system having a tunable exhaust sound is illustrated in FIGS. 1 through 3, embodiments of a resonator for use in such a system are illustrated in FIGS. 4 through 7, and embodiments of mufflers for use in such a system are illustrated in FIGS. 8 through 14. It is to be understood that the concepts illustrated in the accompanying figures and discussed in relation thereto are not intended as being limiting as certain variations, such as the sizes and lengths of the exhaust conduits, the placement of the baffles, and the lengths, widths and depths of the resonators and mufflers may be varied without deviating from the disclosed inventive concept as discussed hereafter.

The disclosed inventive concept solves the limitations of known exhaust systems by providing staggered perforations in two independent chambers of a close coupled resonator, and a tuned amount of mixing via perforations in a separate forward chamber. The exhaust system controls ½-engine order sound by tuning the relative lengths of pipe in each bank and by controlling the amount of mixing between the two banks. The staggered perforations create asymmetry between the two banks of the exhaust system, enhancing all the half order sounds, while the controlled mixing in the first chamber aids with exhaust gas scavenging to aid engine power. The perforations in the first chamber can be used to further fine tune the exhaust order content by changing the number of holes, size of the holes, and locations of the holes in the perforations. This approach also helps eliminate the flutter noise error state created from a system with no mixing between banks. The amount and spacing of the perforations between the rear 2 chambers can also be used to further tune half order sound, and minimize exhaust rasp error states, so high frequency rasp does not become the dominating exhaust character. Accordingly, the exhaust system having a tunable exhaust sound as disclosed herein provides an added level of tuning control that never previously existed. This control enables fine tuning of desired acoustic order content while minimizing error states.

Referring to FIGS. 1 through 3, various views of the exhaust system having a tunable exhaust sound according to the disclosed inventive concept are illustrated. The exhaust system having tunable exhaust sound, generally illustrated as 10, includes a left bank catalytic converter 12, a left bank exhaust header 14, a right bank catalytic converter 16, and a right bank catalytic converter attachment flange 18. The left bank catalytic converter 12 is attached to the left bank exhaust header 14 by an attachment flange that is not illustrated.

The exhaust system having a tunable exhaust sound 10 further includes a tunable resonator 20, a tunable left bank dual mode muffler 22, and a tunable right bank dual mode muffler 24. The resonator 20 is attached to the left bank catalytic converter 12 by a left bank header-to-resonator pipe 26 and the resonator 20 is attached to the right bank catalytic converter 16 by a right bank header-to-resonator pipe 28. The resonator 20 is attached to the left bank dual mode muffler 22 by a left bank resonator-to-muffler pipe 30 and the resonator 20 is attached to the right bank dual mode muffler 24 by a right bank resonator-to-muffler pipe 32. It is to be understood that the placement and shapes of the various components of the exhaust system having a tunable exhaust sound 10 may be adapted for applications other than that illustrated in the various figures.

Figure 4:
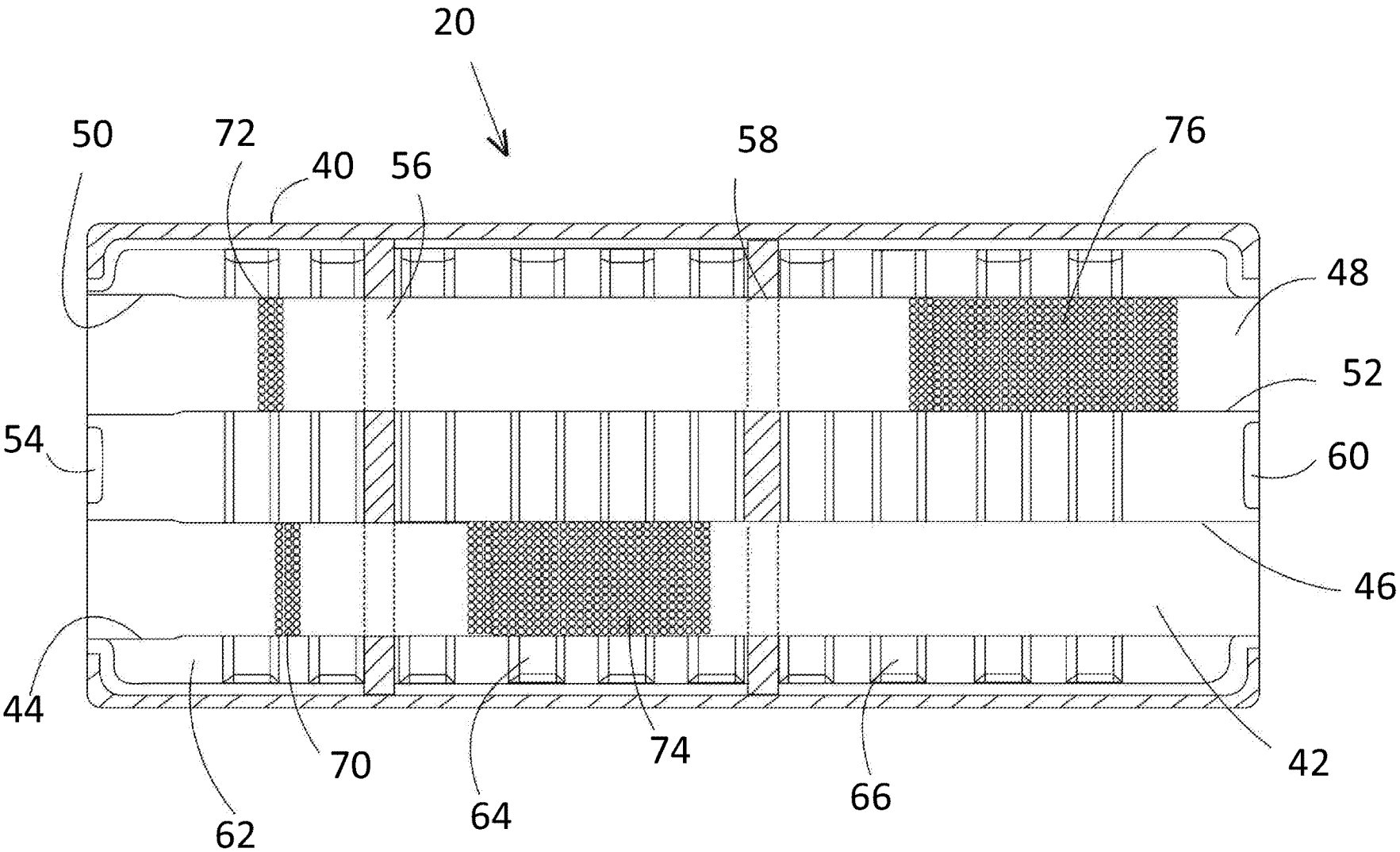
FIG. 4 is a cross-sectional plan view of a resonator for use in the exhaust system according to the disclosed inventive concept.
Figure 5:
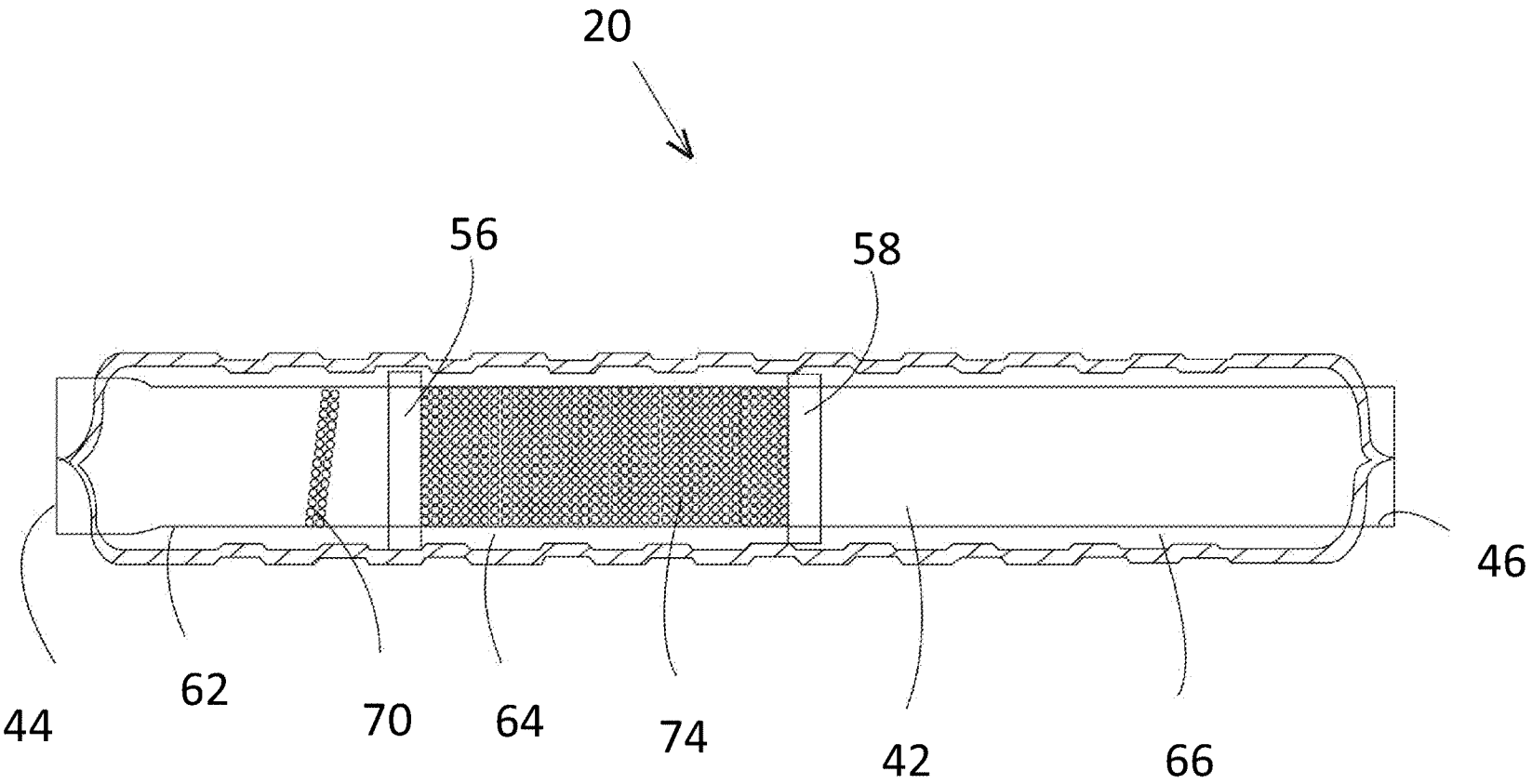
FIG. 5 is a cross-sectional side view of the resonator illustrated in FIG. 4.

FIGS. 4 and 5 illustrate top sectional and bank sectional views respectively of the resonator 20. The resonator 20 includes a housing 40 defining an enclosure. A portion of the housing has been removed to reveal the inner components. However, it will be understood that the enclosure is substantially sealed from the surrounding environment (i.e., isolated from ambient air). The resonator 20 includes a left bank pipe 42 that is attached to the left bank header-to-resonator pipe 26 (shown, for example, in FIG. 1) at a left bank pipe inlet 44. The left bank pipe 42 is attached to the left bank resonator-to-muffler pipe 30 (also shown, for example, in FIG. 1) at a left bank pipe outlet 46. The resonator 20 further includes a right bank pipe 48 that is attached to the right bank header-to-resonator pipe 28 (shown, for example, in FIG. 1) at a right bank pipe inlet 50. The right bank pipe 48 is attached to the right bank resonator-to-muffler pipe 32 (also shown, for example, in FIG. 1) at a right bank pipe outlet 52. The long axes of the left bank pipe 42 and the right bank pipe 48 are substantially parallel. However in other examples, other conduit orientations are possible. In addition, the diameter of each of the left bank pipe 42 and the right bank pipe 48 extending through the housing 40 are preferably but not absolutely substantially equal.

The resonator 20 further includes a front wall 54, a first baffle 56, a second baffle 58, and a back wall 60. The resonator housing 40 and the baffles 56 and 58 may be constructed out of a suitable material such as steel, aluminum, or a polymer. Specifically, a multi-layer housing construction may be employed. For example, an insulator may be positioned between two metal layers to provide sound dampening. However in other examples, other constructions may be used such as a single layer metal housing.

As shown, the front and rear surfaces of the baffles 56 and 58 are substantially flat. However, in other examples, one or more of the surfaces may be curved. A first expansion chamber 62 is formed between the front wall 54 and the first baffle 56. A second expansion chamber 64 is formed between the first baffle 56 and the second baffle 58. A third expansion chamber 66 is formed between the second baffle 58 and the back wall 60. The first expansion chamber 62 is positioned upstream of the second expansion chamber 64 which is positioned upstream of the third expansion chamber 66. However, in other examples, one or both of the baffles may extend lengthwise in the enclosure. Specifically in some examples, one or both of the baffles may be parallel to the central axes first and/or second exhaust conduits. One or both of the baffles may include one or more openings (not shown) to fluidly couple adjacent expansion chambers as desired for sound tuning.

In the first expansion chamber 62, the left bank pipe 42 includes a left first perforated portion 70 defined by a relatively narrow band of perforations that ring the left bank pipe 42 and the right bank pipe 48 includes a right first perforated portion 72 defined by a relatively narrow band of perforations that ring the right bank pipe 48. As illustrated in FIG. 5, the perforated portion 70 (and the perforated portion 72) is formed at an angle around the pipes relative to the long axis of the pipes. This arrangement also aids the designer in tuning the sound of the system. Both of the perforated portions 70 and 72 are relatively narrow compared with other pipe perforations as illustrated in FIGS. 4 and 5 and as discussed in conjunction therewith.

In the second expansion chamber 64, the left bank pipe 42 includes a second left perforated portion 74 defined by a relatively wide band of perforations that ring the left bank pipe 42. The right bank pipe 48 is free of perforations in the second expansion chamber 64. In the third expansion chamber 66, the right bank pipe 48 includes a second right perforated portion 76 defined by a relatively wide band of perforations that ring the right bank pipe 48. The left bank pipe 42 is free of perforations in the third expansion chamber 66. It is to be understood that while the left bank pipe 42 includes perforations and the right bank pipe 48 is free of perforations in the second expansion chamber 64 and the right bank pipe 48 includes perforations and the left bank pipe 42 is free of perforations in the third expansion chamber 66, the opposite may be the case.

The size, number, and spacing of the perforations in both of the exhaust conduits may be identical. However, in other examples one perforated portion may include a varying number of perforations, differently sized perforations, and/or differently spaced perforations from another perforated portion. Furthermore, the perforations in the left bank pipe 42 may be asymmetric and the perforations in the right bank pipe 48 may be symmetric or vice versa. In addition, the perforations in one of the perforated portions may be larger than the perforations in another perforated portion. Still further, the sizes of the perforations in a single perforated portion may differ.

Moreover, the perforations may extend radially around each portion of the pipes 42 and 48. Particularly, the perforations may extend a full 360° around the portion (around the entire circumference) of the exhaust conduits enclosed in the resonator housing 40. In other embodiments, the perforations may only partially extend radially around the exhaust conduits. In some examples the perforations may extend between 45°-180° around one or both of the pipes 42 and 48. In such an example, the perforations may face the outer wall of the housing 40 or may face the center of the enclosure to direct the sound wave in a direction that is conducive to attenuating the targeted frequency or frequency ranges generated by the engine in the exhaust.

Figure 6:
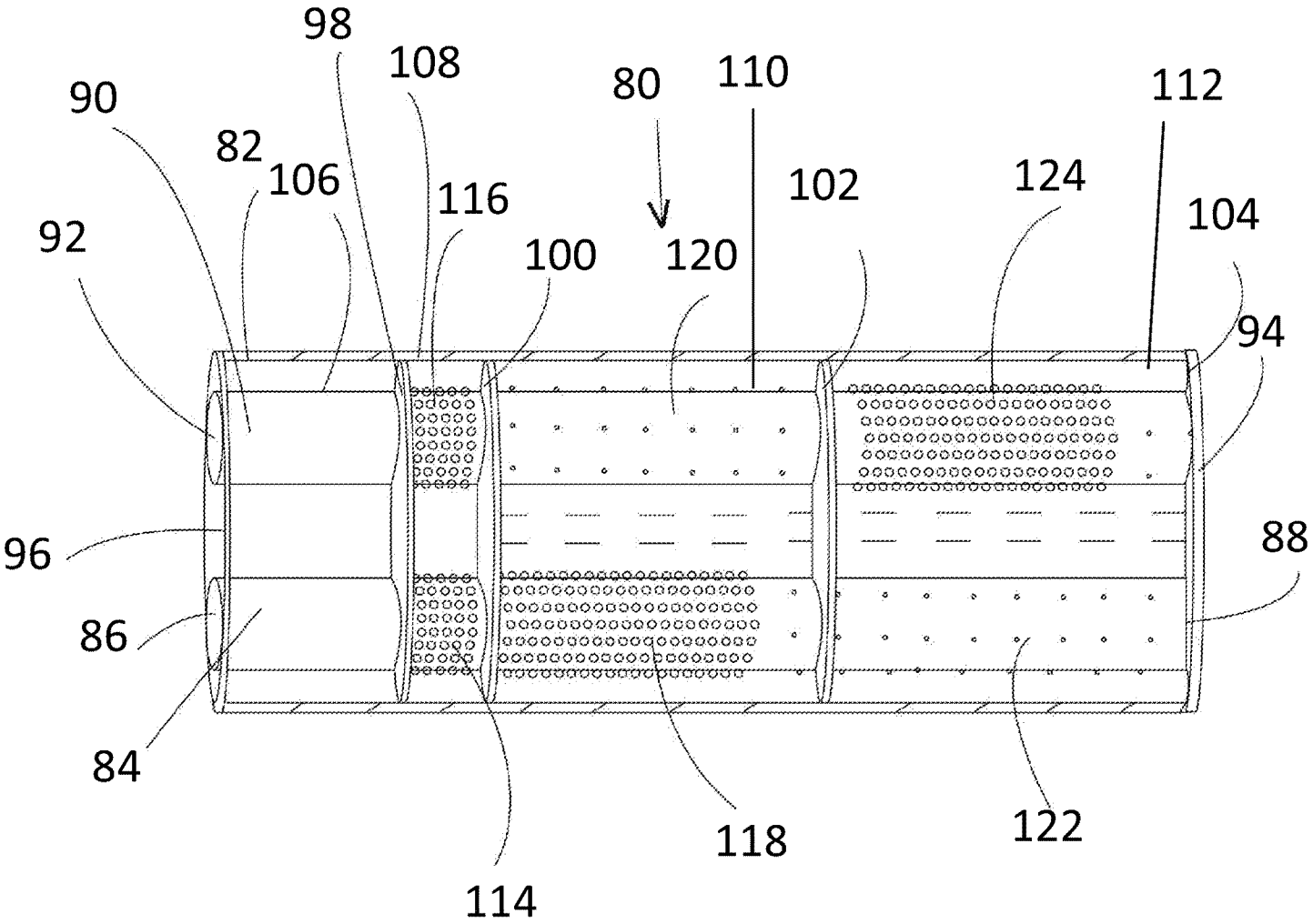
FIG. 6 is a cross-sectional plan view of an additional resonator for use in the exhaust system according to the disclosed inventive concept.

FIG. 6 illustrates a top sectional view of an alternate embodiment of a resonator for use in the disclosed exhaust system having a tunable exhaust sound. The resonator, generally illustrated as 80, includes a housing 82 defining an enclosure. A portion of the housing has been removed to reveal the inner components. However, it will be understood that the enclosure is substantially sealed from the surrounding environment. The resonator 80 includes a left bank pipe 84 that is attached to the left bank header-to-resonator pipe 26 at a left pipe inlet 86. The left bank pipe 84 is attached to the left bank resonator-to-muffler pipe 30 (also shown, for example, in FIG. 1) at a left bank pipe outlet 88. The resonator 80 further includes a right bank pipe 90 that is attached to the right bank header-to-resonator pipe 28 (shown, for example, in FIG. 1) at a right bank pipe inlet 92. The right bank pipe 90 is attached to the right bank resonator-to-muffler pipe 32 (also shown, for example, in FIG. 1) at a right bank pipe outlet 94. The long axes of the left bank pipe 84 and the right bank pipe 90 are substantially parallel. However in other examples, other conduit orientations are possible. In addition, the diameter of each of the left bank pipe 84 and the right bank pipe 90 extending through the housing 82 are preferably but not absolutely substantially equal.

The resonator 80 further includes a front wall 96, a first baffle 98, a second baffle 100, a third baffle 102, and a back wall 104. The resonator housing 82 and the baffles 98, 100 and 102 may be constructed out of a suitable material such as steel, aluminum, or a polymer. Specifically, a multi-layer housing construction may be employed. For example, an insulator may be positioned between two metal layers to provide sound dampening. However in other examples, other constructions may be used such as a single layer metal housing.

As shown, the front and rear surfaces of the baffles 98, 100 and 102 are substantially flat. However, in other examples, one or more of the surfaces may be curved. A dead chamber of dead space 106 is formed between the front wall 96 and the first baffle 98. A first expansion chamber 108 is formed between the first baffle 98 and the second baffle 100. A second expansion chamber 110 is formed between the second baffle 100 and the third baffle 102. The second expansion chamber 110 functions in generally the same way as an H-pipe or crossover pipe to improve low end torque, increase horsepower, and, significantly as it relates to the disclosed inventive concept, enhance the sound of the engine sound by providing a deeper and lower tone. A third expansion chamber 112 is formed between the third baffle 102 and the back wall 104. The dead chamber 106 is positioned upstream of the first expansion chamber 108, the first expansion chamber 108 is positioned upstream of the second expansion chamber 110 which is positioned upstream of the third expansion chamber 112. However, in other examples, one or both of the baffles may extend lengthwise in the enclosure. Specifically in some examples, one or both of the baffles may be parallel to the central axes first and/or second exhaust conduits. One or both of the baffles may include one or more openings (not shown) to fluidly couple adjacent expansion chambers as desired for sound tuning.

As illustrated, neither the left bank pipe 84 nor the right bank pipe 90 is perforated within the dead chamber 106. In the first expansion chamber 108, the left bank pipe 84 includes a left first perforated portion 114 defined by a narrow band of perforations that ring the left bank pipe 84 and the right bank pipe 90 includes a right first perforated portion 116.

In the second expansion chamber 110, the left bank pipe 84 includes a left second left perforated portion 118 defined by a relatively wide band of perforations that ring the left bank pipe 84. The right bank pipe 90 includes a right second perforated portion 120. However, the number of perforations on the right second perforated portion 120 is much less than the number of perforations on the left second perforated portion 118. The number of perforations on each of the portions 118 and 120 can be changed as needed for proper tuning of the exhaust sound.

In the third expansion chamber 112, the right bank pipe 90 includes a right third perforated portion 124 defined by a relatively wide band of perforations that ring the right bank pipe 90. The left bank pipe 84 includes a left third perforated portion 122. However, the number of perforations on the left third perforated portion 122 is much less than the number of perforations on the right third perforated portion 124. The number of perforations on each of the portions 122 and 124 can be changed as needed for proper tuning of the exhaust sound.

While perforations are illustrated on the right second perforated portion 120, it is possible that the portion 120 would have no perforations at all. Furthermore, while perforations are illustrated on the left third perforated portion 122, it is possible that the portion 122 would have no perforations at all. It is also possible that perforations may be provided on portion 120 and not on portion 122 or on portion 122 but not on portion 120. The decision regarding the inclusion or exclusion of perforations on portions 120 and 122 is made based on tuning of the resonator 80 so as to achieve the desired exhaust sound.

The size, number, and spacing of the perforations in both of the exhaust conduits may be identical. However, in other examples one perforated portion may include a varying number of perforations, differently sized perforations, and/or differently spaced perforations from another perforated portion. Furthermore, the perforations in the left bank pipe 84 may be asymmetric and the perforations in the right bank pipe 90 may be symmetric or vice versa. In addition, the perforations in one of the perforated portions may be larger than the perforations in another perforated portion. Still further, the sizes of the perforations in a single perforated portion may differ.

Moreover, the perforations may extend radially around each portion of the pipes 84 and 90. Particularly, the perforations may extend a full 360° around the portion (around the entire circumference) of the exhaust conduits enclosed in the resonator housing 82. In other embodiments, the perforations may only partially extend radially around the exhaust conduits. In some examples the perforations may extend between 45°-180° around one or both of the pipes 84 and 90. In such an example, the perforations may face the outer wall of the housing 82 or may face the center of the enclosure to direct the sound wave in a direction that is conducive to attenuating the targeted frequency or frequency ranges generated by the engine in the exhaust.

In a variation of the embodiment of the resonator 80 illustrated in FIG. 6, the first baffle 98 may be excluded from the housing 82, thereby converting the dead chamber 106 to an active chamber. In a further variation of this variation in which the first baffle 98 is excluded, the perforations of the left second left perforated portion 118 and the perforations of the right second perforated portion 120 could be reduced so that, for example, a band of perforations half as wide as that illustrated in FIG. 6 are provided. In addition, as another variation, the number of bands in the first expansion chamber 114 could be increased.

Figure 7:
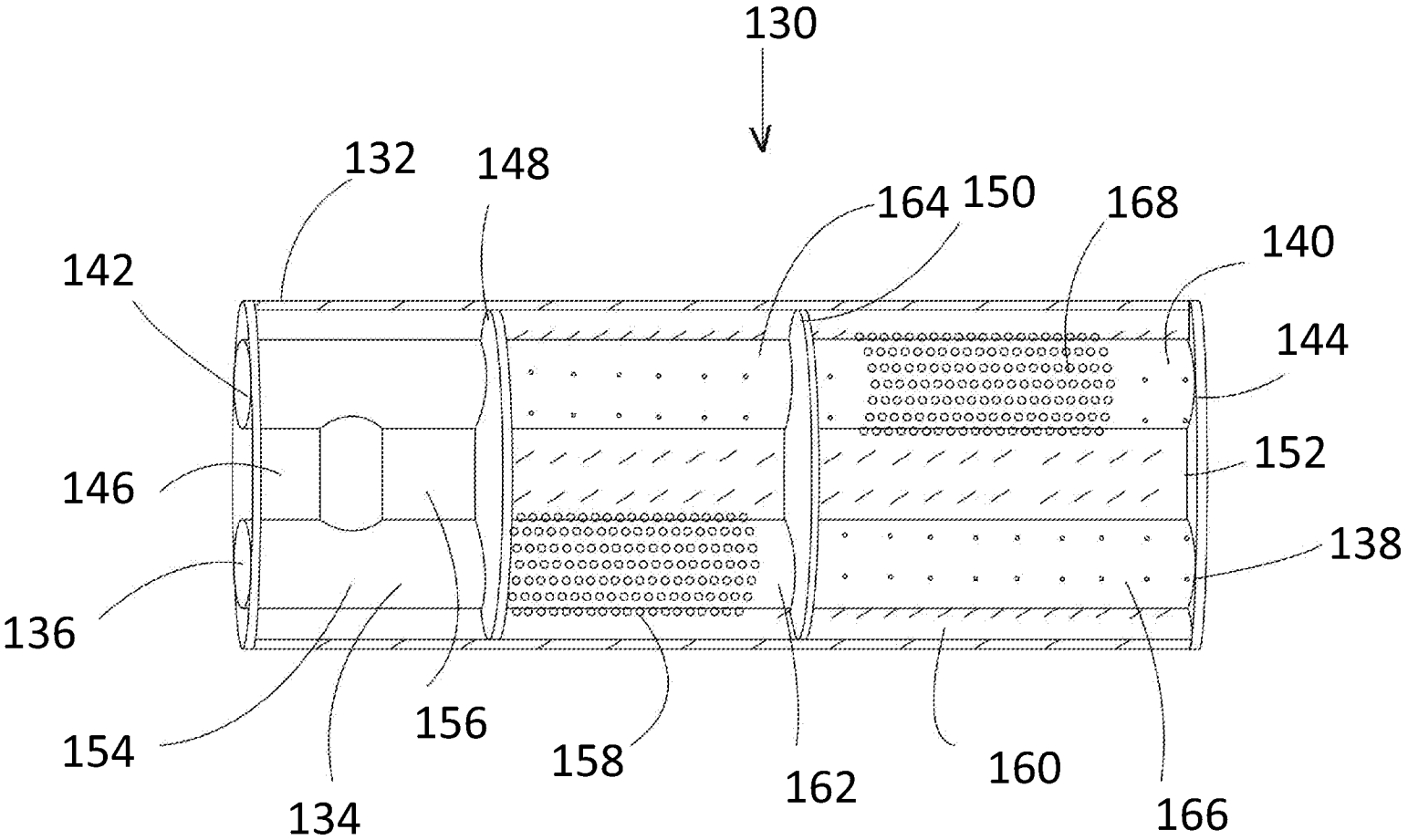
FIG. 7 is a cross-sectional plan view of still another resonator for use in the exhaust system according to the disclosed inventive concept.

FIG. 7 illustrates a top sectional view of a further alternate embodiment of a resonator for use in the disclosed exhaust system having a tunable exhaust sound. The resonator, generally illustrated as 130, includes a housing 132 defining an enclosure, a portion of which having been removed to reveal the inner components. The resonator 130 includes a left bank pipe 134 that is attached to the left bank header-to-resonator pipe 26 at a left pipe inlet 136. The left bank pipe 134 is attached to the left bank resonator-to-muffler pipe 30 (also shown, for example, in FIG. 1) at a left bank pipe outlet 138. The resonator 130 further includes a right bank pipe 140 that is attached to the right bank header-to-resonator pipe 28 (shown, for example, in FIG. 1) at a right bank pipe inlet 142. The right bank pipe 140 is attached to the right bank resonator-to-muffler pipe 32 (also shown, for example, in FIG. 1) at a right bank pipe outlet 144. The long axes of the left bank pipe 134 and the right bank pipe 140 are substantially parallel. However in other examples, other conduit orientations are possible. In addition, the diameter of each of the left bank pipe 134 and the right bank pipe 140 extending through the housing 132 are preferably but not absolutely substantially equal.

The resonator 130 further includes a front wall 146, a first baffle 148, a second baffle 150, and a back wall 152. The resonator housing 132 and the baffles 148 and 152 may be constructed out of a suitable material such as steel, aluminum, or a polymer. Specifically, a multi-layer housing construction may be employed. For example, an insulator may be positioned between two metal layers to provide sound dampening. However in other examples, other constructions may be used such as a single layer metal housing.

As shown, the front and rear surfaces of the baffles 148 and 152 are substantially flat. However, in other examples, one or more of the surfaces may be curved. An H-pipe or crossover pipe 154 is provided within a dead chamber 156 formed between the front wall 146 and the first baffle 148. The H-pipe or crossover pipe 154 provides a number of advantages which include improved low end torque, increased horsepower, and an engine sounding having a deeper and lower tone. A first expansion chamber 158 is formed between the first baffle 148 and the second baffle 150. A second expansion chamber 160 is formed between the second baffle 150 and the back wall 152. The dead chamber 156 is positioned upstream of the first expansion chamber 158 and the first expansion chamber 158 is positioned upstream of the second expansion chamber 160. However, in other examples, one or both of the baffles may extend lengthwise in the enclosure. Specifically in some examples, one or both of the baffles may be parallel to the central axes first and/or second exhaust conduits. One or both of the baffles may include one or more openings (not shown) to fluidly couple adjacent expansion chambers as desired for sound tuning.

As illustrated, neither the left bank pipe 134 nor the right bank pipe 140 is perforated within the dead chamber 156. In the first expansion chamber 158, the left bank pipe 134 includes a left first perforated portion 162 defined by a relatively wide band of perforations that ring the left bank pipe 134. The right bank pipe 140 includes a right first perforated portion 164. However, the number of perforations on the right first perforated portion 164 is much less than the number of perforations on the left first perforated portion 162. The number of perforations on each of the portions 162 and 164 can be changed as needed for proper tuning of the exhaust sound.

In the second expansion chamber 160, the right bank pipe 140 includes a right second perforated portion 168 defined by a relatively wide band of perforations that ring the right bank pipe 140. The left bank pipe 134 includes a left second perforated portion 166. However, the number of perforations on the left second perforated portion 166 is much less than the number of perforations on the right second perforated portion 168. The number of perforations on each of the portions 166 and 168 can be changed as needed for proper tuning of the exhaust sound.

The size, number, and spacing of the perforations in both of the exhaust conduits may be identical. However, in other examples one perforated portion may include a varying number of perforations, differently sized perforations, and/or differently spaced perforations from another perforated portion. Furthermore, the perforations in the left bank pipe 134 may be asymmetric and the perforations in the right bank pipe 140 may be symmetric or vice versa. In addition, the perforations in one of the perforated portions may be larger than the perforations in another perforated portion. Still further, the sizes of the perforations in a single perforated portion may differ.

Moreover, the perforations may extend radially around each portion of the pipes 134 and 140. Particularly, the perforations may extend a full 360° around the portion (around the entire circumference) of the exhaust conduits enclosed in the resonator housing 132. In other embodiments, the perforations may only partially extend radially around the exhaust conduits. In some examples the perforations may extend between 45°-180° around one or both of the pipes 134 and 140. In such an example, the perforations may face the outer wall of the housing 132 or may face the center of the enclosure to direct the sound wave in a direction that is conducive to attenuating the targeted frequency or frequency ranges generated by the engine in the exhaust.

The various embodiments of resonators for use with the disclosed exhaust system having a tunable exhaust sound discussed above and illustrated in FIGS. 4 through 7 are enhanced by association with the muffler embodiments of the disclosed inventive concept which are illustrated in FIGS. 8 through 14. The specific resonator and the specific muffler can be selectively used and tuned to provide a desired engine sound.

Figure 8:
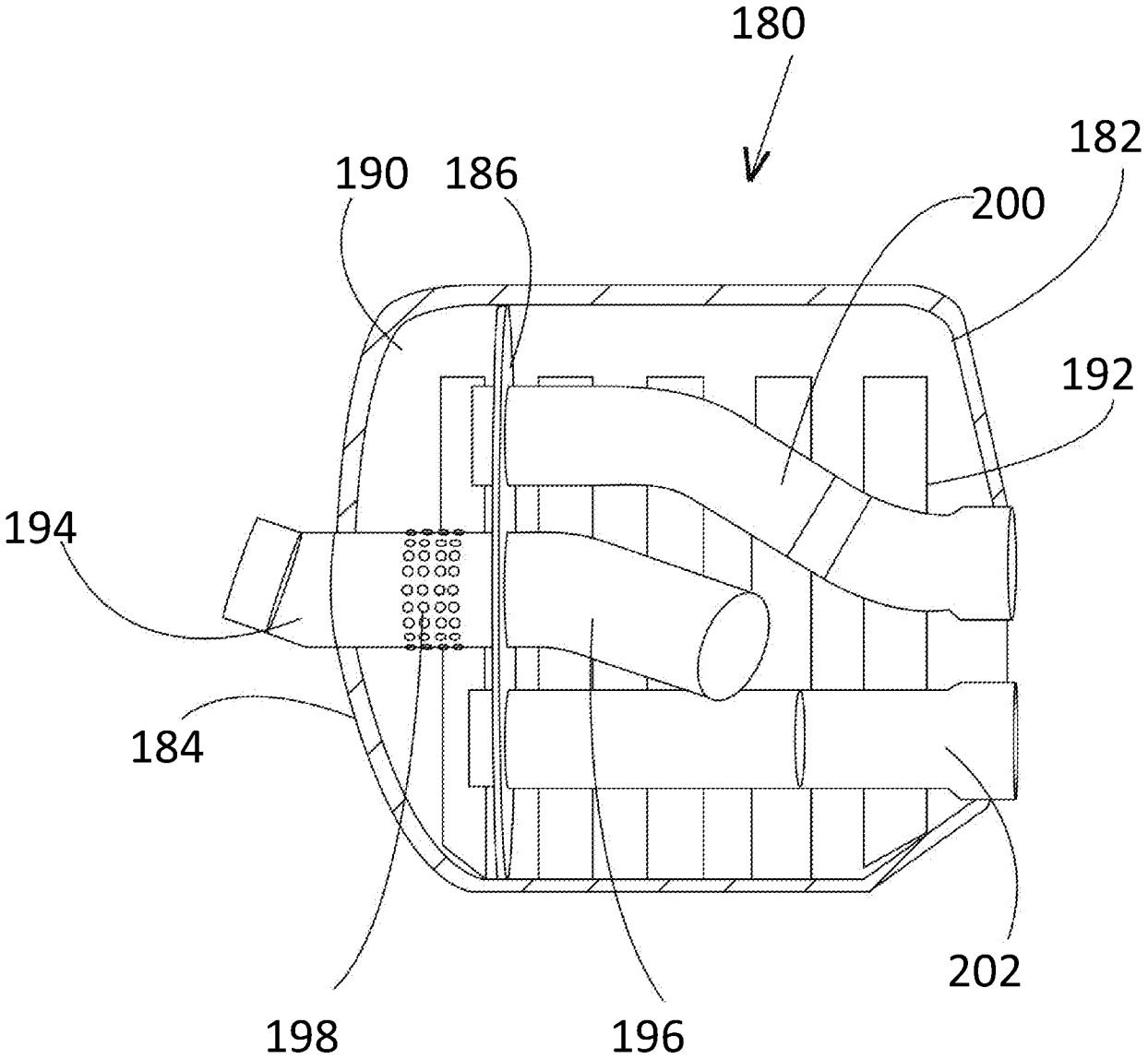
FIG. 8 is a cross-sectional plan view of a muffler for use in the exhaust system according to the disclosed inventive concept.

Referring to FIG. 8, a cross-sectional plan view of a muffler, generally illustrated as 180, is illustrated. The muffler 180 includes a housing 182 defining an enclosure, a portion of which having been removed to reveal the inner components. The housing 182 comprises a front wall 184, a baffle 186, and a back wall 188. The resonator housing 182 and the baffle 186 may be constructed out of a suitable material such as steel, aluminum, or a polymer. Specifically, a multi-layer housing construction may be employed. For example, an insulator may be positioned between two metal layers to provide sound dampening. However in other examples, other constructions may be used such as a single layer metal housing. As shown, the front and rear surfaces of the baffle 186 are substantially flat.

An expansion chamber 190 is formed between the front wall 184 and the baffle 186. A dead chamber or space 192 is formed between the baffle 186 and the back wall 188. The baffle 186 is illustrated as being perpendicular to the long axis of the housing 182. However, in another example, the baffle 186 may be parallel to the long axis. The baffle 186 may include one or more openings (not shown) to fluidly couple the expansion chamber 190 and the dead chamber 192 as desired for sound tuning.

An inlet pipe 194 is attached to one of the resonator-to-muffler pipes 30 or 32. The inlet pipe 194 preferably but not absolutely includes a bend 196. The inlet pipe 194 further includes a band of perforations 198. The perforations may be of uniform size or may be different. The perforations may also extend radially around the inlet pipe 194. Particularly, the perforations may extend a full 360° around the entire circumference of the inlet pipe 194. In another embodiment, the perforations may only partially extend radially around the inlet pipe 194. In some examples the perforations may extend between 45°-180° around the inlet pipe 194. In such an example, the perforations may face the outer wall of the housing 182 or may face the center of the enclosure to direct the sound wave in a direction that is conducive to attenuating the targeted frequency or frequency ranges generated by the engine in the exhaust. The muffler 180 further includes a first outlet pipe 200 that extends from the expansion chamber 190, through the dead chamber 192, and out of the back wall 188. The muffler 180 additionally includes a second outlet pipe 202 that also extends from the expansion chamber 190, through the dead chamber 192, and out of the back wall 188. The illustrated shapes of the first outlet pipe 200 and the second outlet pipe 202 are suggested and are not intended as being limiting.

Figure 9:
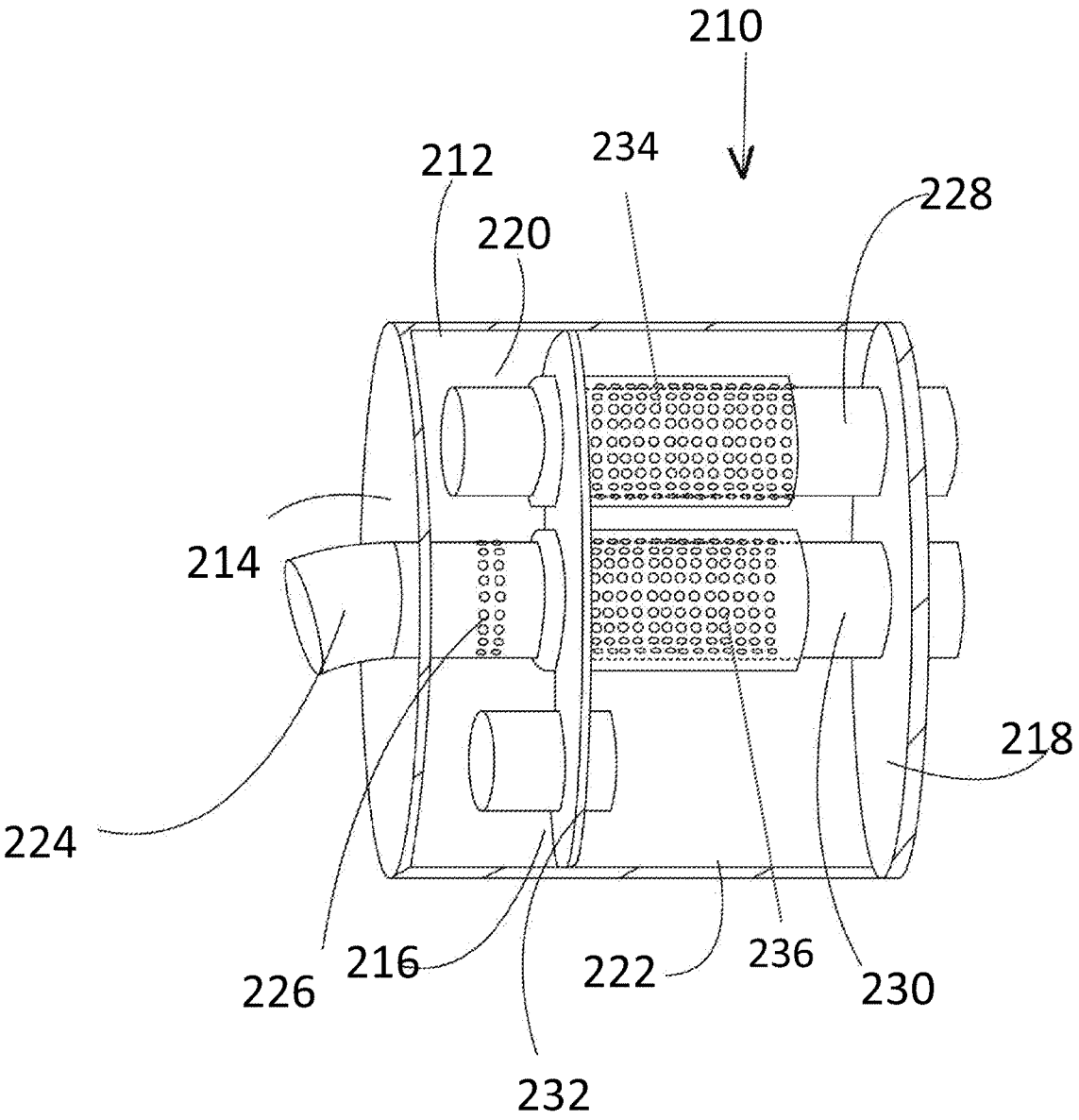
FIG. 9 is a cross-sectional plan view of an additional muffler for use in the exhaust system according to the disclosed inventive concept.

Referring to FIG. 9, a cross-sectional plan view of an alternative embodiment of a muffler according to the disclosed inventive concept is shown. The muffler of FIG. 9, generally illustrated as 210, includes a housing 212 defining an enclosure, a portion of which having been removed to reveal the inner components. The housing 212 comprises a front wall 214, a baffle 216, and a back wall 218. The resonator housing 212 and the baffle 216 may be constructed out of a suitable material such as steel, aluminum, or a polymer. Specifically, a multi-layer housing construction may be employed. For example, an insulator may be positioned between two metal layers to provide sound dampening. However in other examples, other constructions may be used such as a single layer metal housing. As shown, the front and rear surfaces of the baffle 216 are substantially flat.

A first expansion chamber 220 is formed between the front wall 214 and the baffle 216. A second expansion chamber 222 is formed between the baffle 216 and the back wall 218. The baffle 216 is illustrated as being perpendicular to the long axis of the housing 212. However, in another example, the baffle 216 may be parallel to the long axis of the housing 212.

An inlet pipe 224 is attached to one of the resonator-to-muffler pipes 30 or 32. The inlet pipe 224 includes a relatively narrow band of perforations 226. The muffler 210 further includes a first outlet pipe 228 that extends from the first expansion chamber 220, through the second expansion chamber 222, and out of the back wall 218. The muffler 210 additionally includes a second outlet pipe 230 that also extends from the first expansion chamber 220, through the second expansion 222, and out of the back wall 218. The illustrated shapes of the first outlet pipe 228 and the second outlet pipe 230 are suggested and are not intended as being limiting.

A band of peripheral perforations 234 is formed on the first outlet pipe 228 and a band of peripheral perforations 236 is formed on the second outlet pipe 230. The perforations that make up the band 226, the band 234, and the band 236 may be of uniform size or may be different. The perforations 226 may extend radially around the inlet pipe 224. The perforations 234 and 236 may extend radially around the first outlet pipe 228 and the second outlet pipe 230 respectively. Particularly, the perforations 226, 234 and 236 may extend a full 360° around the entire circumference of the inlet pipe 224 and the outlet pipes 228 and 230 respectively In another embodiment, the perforations may only partially extend radially around the pipes 224, 228 and 230. In some examples the perforations may extend between 45°-180° around the pipes 224, 228 and 230. In such an example, the perforations may face the outer wall of the housing 212 or may face the center of the enclosure to direct the sound wave in a direction that is conducive to attenuating the targeted frequency or frequency ranges generated by the engine in the exhaust.

To further enhance the tunability of the muffler 210, a Helmholtz tuner 232 is preferably provided in the baffle 216 between the first expansion chamber 220 and the second expansion chamber 222. The Helmholtz tuner 232 provides the system designer with increased flexibility as to engine sound.

As an additional variation to the exhaust system having a tunable exhaust sound according to the disclosed inventive concept, at least one outlet pipe of at least one muffler may be fitted with a variable exhaust gas flow assembly to allow for virtually infinite adjustment of the exhaust gas flow out of the muffler, thereby controlling engine volume. The provision of the variable exhaust gas flow assembly also adds to the tunability of the exhaust sound of the vehicle to which the disclosed system is attached.

Referring to FIGS. 10 through 14, a variable exhaust gas flow assembly 240 is fitted to one or both of the outlet pipes of the mufflers 22 and 24. The variable exhaust gas flow assembly 240 may be adjusted automatically by, for example, the vehicle's on-board computer to remain relatively closed when the vehicle is cold as this condition would ordinarily exist when the vehicle is first started in the morning. By reducing exhaust gas flow, the vehicle engine noise will be damped to avoid excessive volume at a time when the operator's neighbors may expect quiet. It is also possible for the variable exhaust gas flow assembly 240 to be manually adjusted by the vehicle operator.

Figure 10:
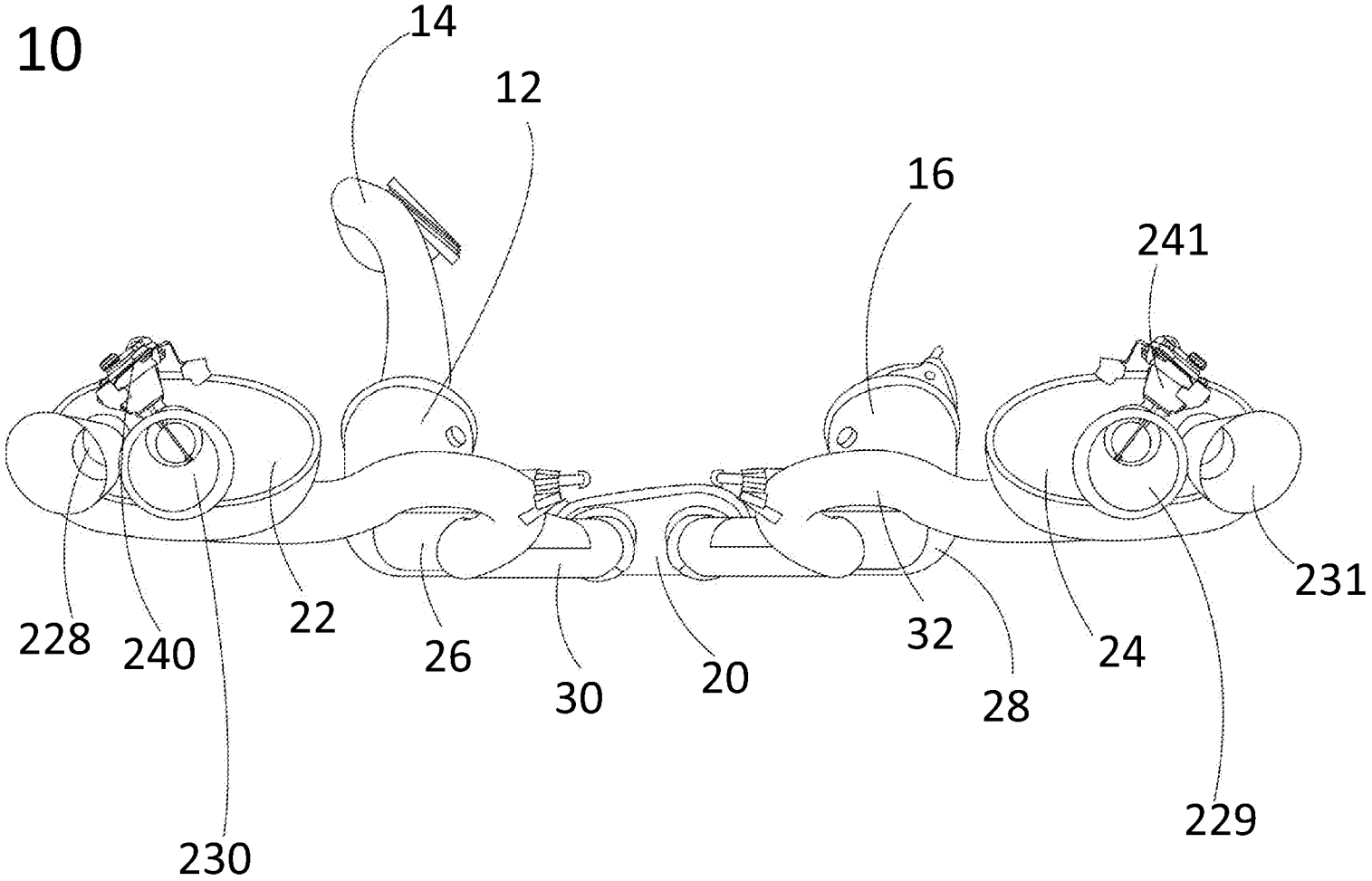
FIG. 10 is a view of the exhaust system having a tunable exhaust sound according to an embodiment of the disclosed inventive concept viewed from the muffler end in which a variable exhaust gas flow assembly is attached to one of the outlet pipes.
Figure 11:
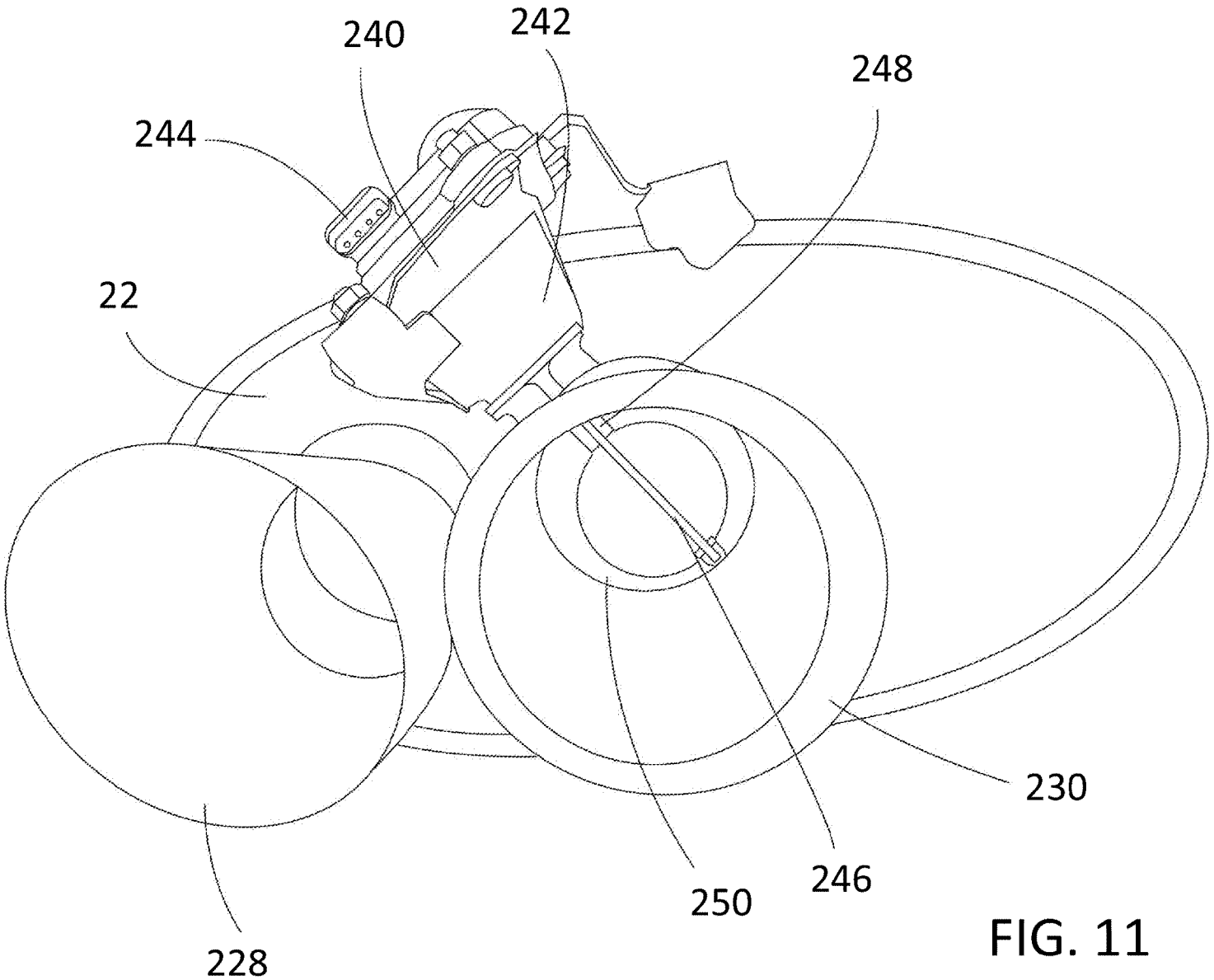
FIG. 11 is an end view of a muffler of FIG. 10.
Figure 12:
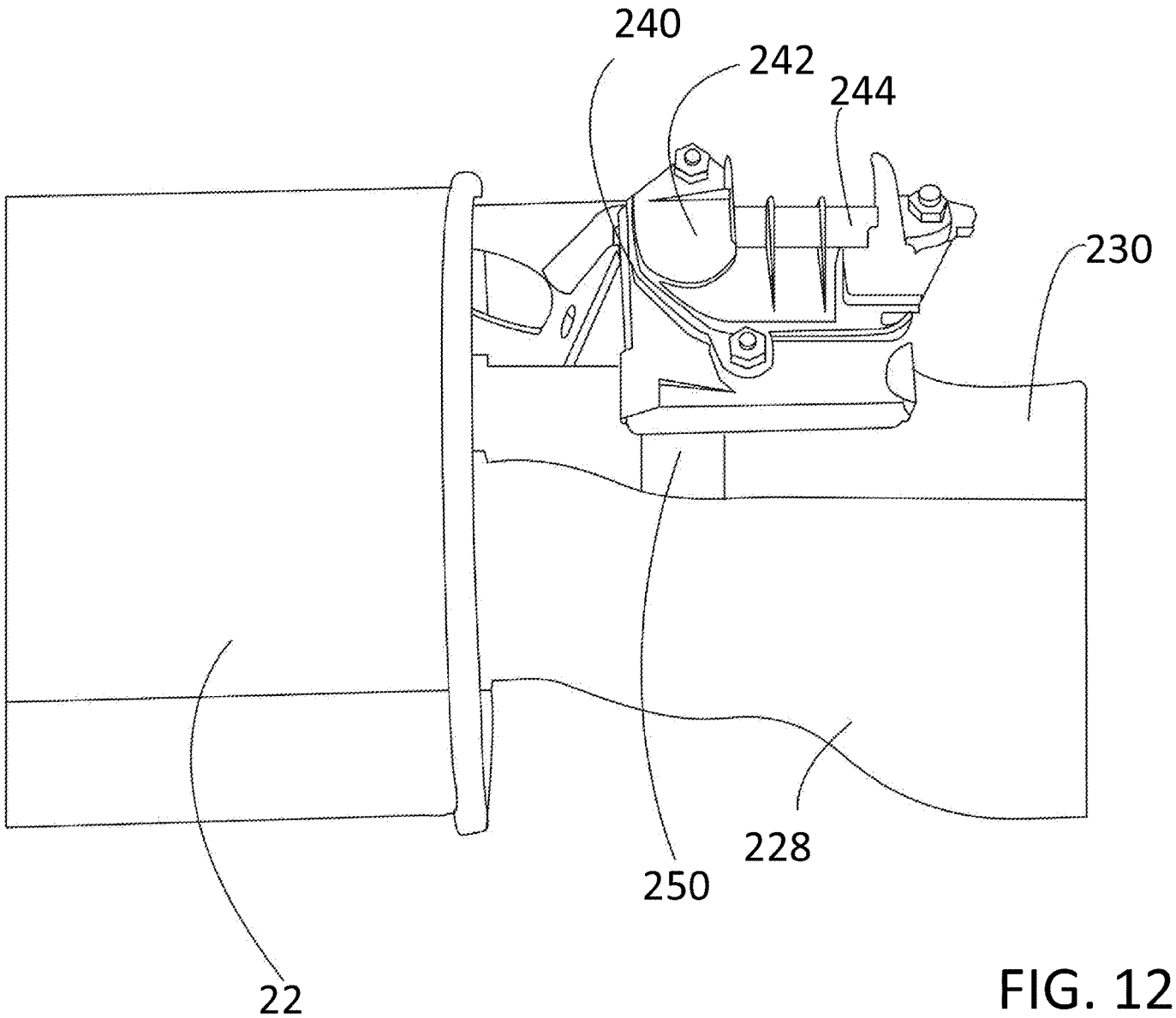
FIG. 12 is a top view of the muffler of FIG. 11.
Figure 13:
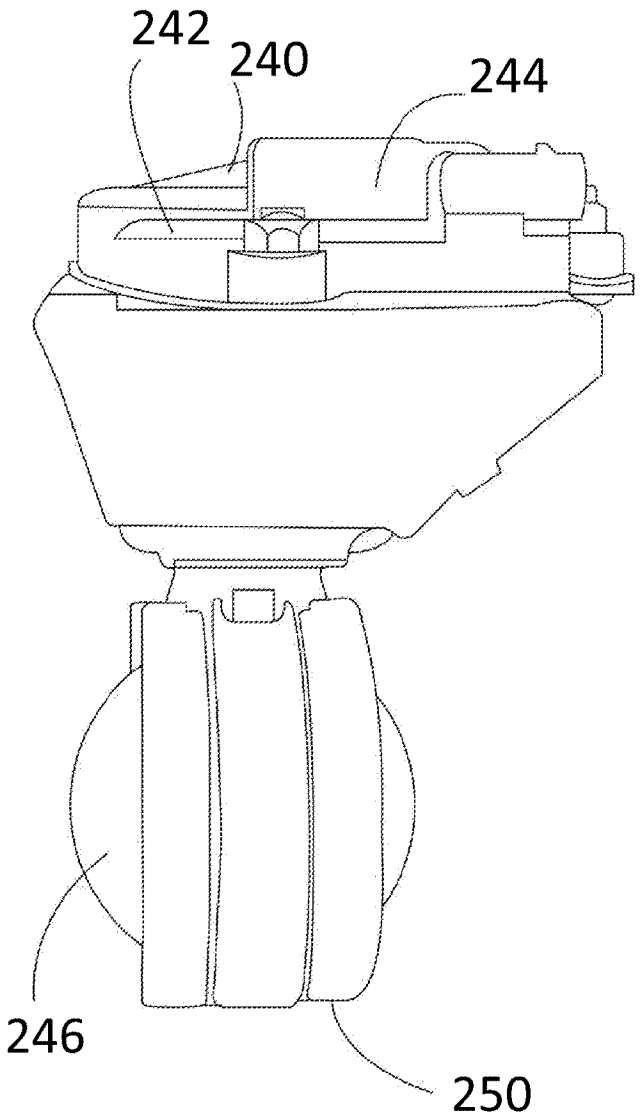
FIG. 13 is a side view of the variable exhaust gas flow assembly of the outlet pipe shown in FIGS. 10 through 12.
Figure 14:
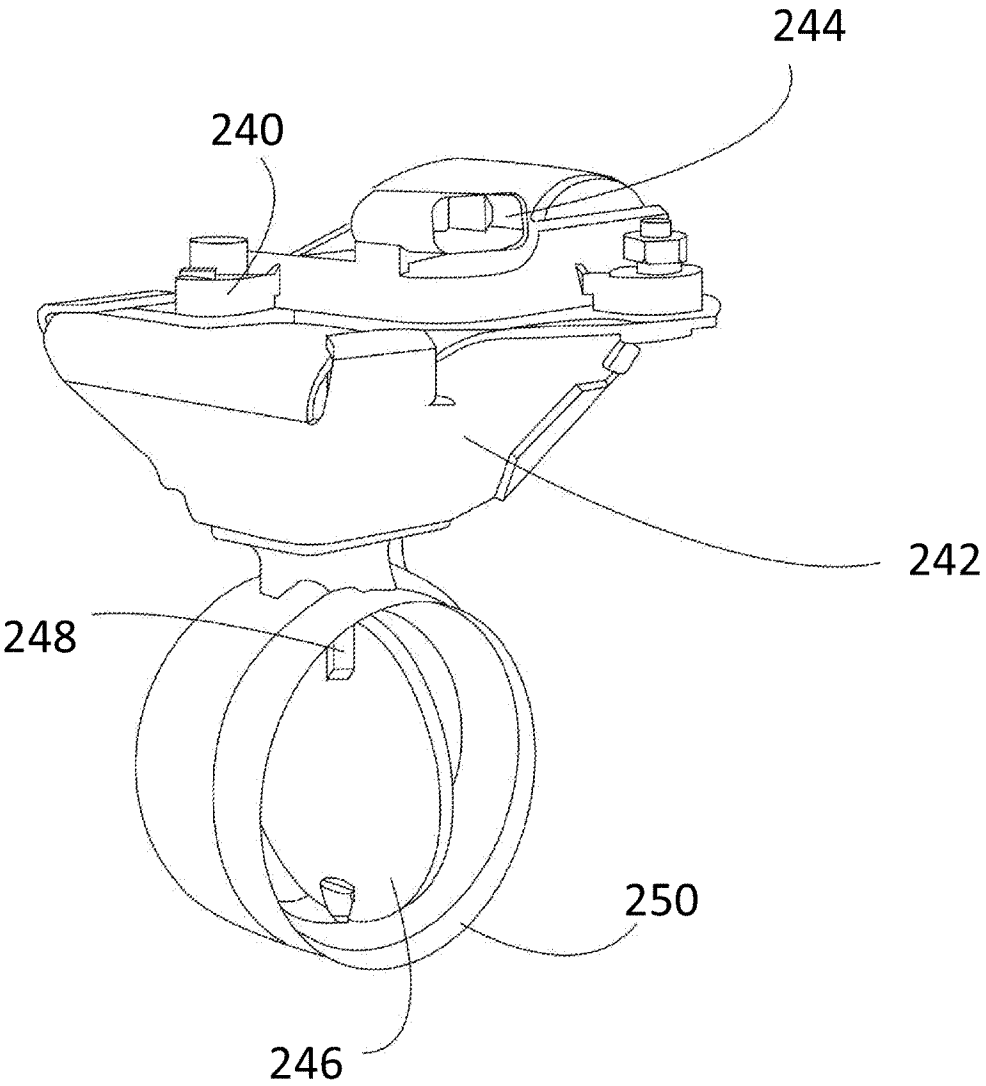
FIG. 14 is a perspective view of the variable exhaust gas flow assembly of FIG. 13.

As shown in FIG. 10, the muffler 22 is illustrated as having the variable exhaust gas flow assembly 240 attached to the second outlet pipe 230 while no assembly is fitted to the first outlet pipe 228. In addition, a variable exhaust gas flow assembly 241 is attached to a muffler outlet 229 of the muffler 24 while no variable exhaust gas flow assembly 241 is attached to a muffler outlet 231. Alternatively, variable exhaust gas flow assemblies could be attached to all of the muffler outlets or only one.

Referring to FIGS. 11 through 14, the variable exhaust gas flow assembly 240 includes an actuator 242 having a coupler 244 for attachment of a conduit of the vehicle's electrical system. An exhaust gas flow regulating vane 246 is attached to the actuator 242 by way of a vane shaft 248. The flow regulating vane 246 and a portion of the vane shaft 248 are housed within a vane housing 250.

The actuator 242 controls the position of the vane shaft 248 and thus the position of the flow regulating vane 246. The position of the flow regulating vane 246 is virtually infinite and, accordingly, allows for a broad range of exhaust flow and, accordingly, a high degree of adjustability of the engine sound. The flow regulating vane 246 is illustrated in its closed position in FIGS. 10 and 11 and in its open position in FIGS. 13 and 14. The position of the flow regulating vane 246 may be adjusted to any position between the open and closed positions.

One skilled in the art will readily recognize from such discussion, and from the accompanying drawings and claims that various changes, modifications and variations can be made therein without departing from the true spirit and fair scope of the invention as defined by the following claims.

What is claimed is:

1. An exhaust system for a vehicle, the system having a tunable exhaust sound, the system comprising:

a resonator having at least two expansion chambers and first and second exhaust conduits passing through said chambers, each of said conduits having a long axis, at least one of said conduits having a band of peripheral perforations, said band being at non-right angle relative to said long axis;

first and second pipes for delivering exhaust gases to said first and second exhaust conduits respectively;

first and second mufflers, at least one of said mufflers including an infinitely variable exhaust gas assembly; and first and second pipes for delivering exhaust gases from said first and second conduits to said first and second mufflers respectively.

2. An exhaust system for a vehicle, the system having a tunable exhaust sound, the system comprising:

a resonator having at least two expansion chambers and first and second exhaust conduits passing through said chambers, each of said conduits having a long axis, at least one of said conduits having a band of peripheral perforations, said band being at an angle relative to said long axis;

first and second pipes for delivering exhaust gases to said first and second exhaust conduits respectively;

first and second mufflers, at least one of said mufflers including an infinitely variable exhaust gas assembly; and first and second pipes for delivering exhaust gases from said first and second conduits to said first and second mufflers respectively, wherein said at least two expansion chambers includes a first expansion chamber and a second expansion chamber, said band of peripheral perforations being formed on one of said conduits is formed on said first conduit in said first expansion chamber, and wherein the other of said conduits includes a band of peripheral perforations formed in said second conduit in said first expansion chamber, said band formed on said second conduit being at an angle relative to said long axis.

3. The exhaust system for a vehicle of claim 2, wherein said band on said first conduit and said band on said second conduit being offset relative to one another.

4. The exhaust system for a vehicle of claim 3, wherein said resonator includes a front wall, a first baffle, a second baffle, and a back wall, said expansion chambers including a first expansion chamber defined between said front wall and said first baffle, a second expansion chamber defined between said first baffle and said second baffle, and a third expansion chamber defied between said second baffle and said back wall, said angled bands being formed on said conduits in said first expansion chamber.

5. The exhaust system for a vehicle of claim 4, further including a band of perforations formed on one of said exhaust conduits in said second expansion chamber and a band of perforations formed on the other of said exhaust conduits in said third expansion chamber.

6. The exhaust system for a vehicle of claim 5, wherein said resonator includes a front wall, a first baffle, a second baffle, a third baffle, and a back wall, said expansion chambers including a first expansion chamber defined between said first baffle and said second baffle, a second expansion chamber defined between said second baffle and said third baffle, and a third expansion chamber defined between said third baffle and said back wall, said angled bands being formed on said conduits in said first expansion chamber, said resonator further including a dead air space between said front wall and said first baffle.

7. A resonator for use in a tunable exhaust system for a vehicle, the resonator comprising:

a housing defining an enclosure; first and second expansion chambers; and a first exhaust conduit having a long axis and a second exhaust conduit having a long axis, said conduits extending through said housing and said chambers, at least one of said conduits having a band of peripheral perforations, said band being at non-right angle relative to said long axis.

8. The resonator for use in a tunable exhaust system for a vehicle of claim 7, wherein said band of peripheral perforations is a first band of peripheral perforations and is formed on said first exhaust conduit and wherein said second exhaust conduit includes a second band of peripheral perforations formed thereon, said second band of peripheral perforations also being at an angle relative to said long axis, each of said angled bands being formed within the same expansion chamber.

9. The resonator for use in a tunable exhaust system for a vehicle of claim 8, wherein said housing includes a front wall, a first baffle, a second baffle, and a back wall, said front wall and said first baffle defining a first expansion chamber, said first baffle and said second baffle defining a second expansion chamber, and said second baffle and said back wall defining a third expansion chamber, said at angled bands being formed on said first and second exhaust conduits within said first expansion chamber.

10. The resonator for use in a tunable exhaust system for a vehicle of claim 9, wherein said first exhaust conduit includes a plurality of peripheral perforations formed thereon in said second expansion chamber and said second exhaust conduit is free of perforations in said second expansion chamber and wherein said second exhaust conduit includes a plurality of peripheral perforations formed thereon in said third expansion chamber and said first exhaust conduit is free of perforations in said third expansion chamber.

11. The resonator for use in a tunable exhaust system for a vehicle of claim 9, wherein said first exhaust conduit includes a first number of peripheral perforations formed thereon in said second expansion chamber and said second exhaust conduit includes a second number of peripheral perforations formed thereon in said second expansion chamber, said first number of said peripheral perforations being greater than said second number of perforations.

12. The resonator for use in a tunable exhaust system for a vehicle of claim 9, wherein said second exhaust conduit includes a second number of peripheral perforations formed thereon in said third expansion chamber and said first exhaust conduit includes a first number of peripheral perforations formed thereon in said third expansion chamber, said second number of said peripheral perforations being greater than said first number of perforations.

13. The resonator for use in a tunable exhaust system for a vehicle of claim 7, wherein said housing includes a front wall, a first baffle, a second baffle, a third baffle, and a back wall, said expansion chambers including a first expansion chamber defined between said first baffle and said second baffle, a second expansion chamber defined between said second baffle and said third baffle, and a third expansion chamber defined between said third baffle and said back wall, said angled bands being formed on said conduits in said first expansion chamber, said resonator further including a dead air space between said front wall and said first baffle.

14. A muffler system for use in a tunable exhaust system, the system comprising:

a housing having a first chamber defined by a front wall and a baffle and a second chamber defined by said baffle and a back wall;

a single inlet pipe extending through said front wall and said baffle;

outlet pipes extending from said first chamber through said back wall; and an infinitely variable flow assembly attached to one of said outlet pipes.

15. The muffler system for use in a tunable exhaust system for a vehicle of claim 14, wherein said inlet pipe has a series of peripheral perforations formed thereon and said first chamber is an expansion chamber.

16. The muffler system for use in a tunable exhaust system for a vehicle of claim 14, wherein at least one of said outlet pipes has a series of peripheral perforations formed thereon within said second chamber.

17. The muffler system for use in a tunable exhaust system for a vehicle of claim 14, wherein said outlet pipes are free of perforations and said second chamber is a dead space.

18. The muffler system for use in a tunable exhaust system for a vehicle of claim 14, further including a Helmholtz tuner extending through said baffle from said first chamber into said second chamber.

19. The muffler system for use in a tunable exhaust system for a vehicle of claim 14, wherein inlet pipe includes a portion extending into said second chamber, said portion having a bend.

20. The muffler system for use in a tunable exhaust system for a vehicle of claim 14, wherein said infinite variable flow assembly includes a vane shaft, an exhaust gas regulating vane attached to said vane shaft, and a vane actuator for regulating the position of said vane shaft.

* * * * *